US005093895A

United States Patent [19]

Ghorayeb

[11] Patent Number: 5,093,895

[45] Date of Patent: Mar. 3, 1992

[54] HUMIDIFIER ATTACHABLE TO BASEBOARD RADIATOR

[75] Inventor: Joseph Ghorayeb, Quebec, Canada

[73] Assignees: Robert Brouillette, Boucherville; Lyne Dube, Westmount, both of Canada

[21] Appl. No.: 425,226

[22] Filed: Oct. 23, 1989

[30] Foreign Application Priority Data

Oct. 24, 1988 [CA] Canada ..... 581050

[51] Int. Cl.[5] ..... F23L 13/00; F24F 1/00

[52] U.S. Cl. ..... 392/395; 392/405; 237/78 R; 237/78 B; 261/142; 126/113; 454/245

[58] Field of Search ..... 219/362; 237/78 A, 78 B, 237/78 C; 98/109, 30; 261/142; 126/113; 392/395, 405, 406

[56] References Cited

U.S. PATENT DOCUMENTS

| | | | |
|---|---|---|---|
| 310,116 | 12/1884 | Beale | 237/78 B |
| 1,250,280 | 12/1917 | Carpenter | 98/109 |
| 1,250,891 | 12/1917 | Johnson | 98/109 |
| 1,309,519 | 7/1919 | Hagerman | 237/78 B |
| 1,535,681 | 4/1925 | Olmstead | 237/78 B |
| 1,597,194 | 8/1926 | Hersch | 126/113 |
| 1,668,000 | 5/1928 | Bender | 98/109 |
| 1,722,877 | 7/1929 | Young | 126/113 |
| 1,729,119 | 9/1929 | Odean | 98/109 |
| 2,997,938 | 8/1961 | Sievert et al. | 98/109 |
| 3,227,064 | 1/1966 | Spangle | 98/109 |
| 3,419,217 | 12/1968 | White et al. | 98/109 |
| 4,226,174 | 10/1980 | Vesper | 98/109 |
| 4,284,129 | 8/1981 | Rogalski | 98/30 |

FOREIGN PATENT DOCUMENTS

| | | | |
|---|---|---|---|
| 166844 | 12/1915 | Canada . | |
| 228799 | 2/1923 | Canada . | |
| 267854 | 1/1927 | Canada . | |
| 301623 | 7/1930 | Canada . | |
| 61-213525 | 9/1986 | Japan | 98/30 |

*Primary Examiner*—Bruce A. Reynolds
*Assistant Examiner*—John A. Jeffery
*Attorney, Agent, or Firm*—Fay, Sharpe, Beall, Fagan, Minnich & McKee

[57] ABSTRACT

A humidifier attachable to a baseboard type radiator of the type comprising a body having an open front portion in which is placed a heating element and a panel placed in front of the heating element such that the panel defines with the body a lower opening and an upper opening. The humidifier comprises a feature which enables securement to the front panel of the baseboard type radiator, a container poriton, and an air entrance aperture located above the container portion in alignment with the upper opening.

8 Claims, 6 Drawing Sheets

HUMIDIFIER ATTACHABLE TO BASEBOARD RADIATOR

This invention relates to a humidifier and more particular to a humidifier which is attachable to a baseboard type radiator.

BACKGROUND OF THE INVENTION

The maintenance of the proper amount of humidity in the air is important for the well being of humans. For example, many people recommend that the humidity level in the living environment be maintained at between 40% and 50% at normal room temperature (approximately 72 degrees F).

Because the total humidity which the air may contain is in relation to the temperature of the air, the proper humidity level is easily maintained and very often largely surpassed in the summer while it can often be maintained in the winter time only by adding humidity to the atmosphere in the home. Indeed, it is necessary to replace the humidity which is lost when warm "humid" inside air is condensed in or on external windows, walls or ceilings or is expelled outside through doors, windows or other openings and such air is replaced by cold air containing much less humidity.

Taking a hot shower or letting the kettle boil will add humidity to the air. However, such additional humidity is usually insufficient to maintain a proper humidity level in the home.

DESCRIPTION OF THE RELATED ART

Various apparatuses have been developed to overcome this difficulty. Modern day devices comprise a water reservoir and electrically powered means to force dry air through the device and expel it together with a certain humidity charge. Such devices may be incorporated in central heating systems or be self contained units. Other devices disperse water through the air as a fine mist.

However, all of these devices require an electrical power source and maintenance and are relatively noisy, expensive and cumbersome.

Previously, various types of evaporators had been developed for use as humidifiers in association with specific types of heating devices which are no longer widely used. See for example Canadian Patents 166,844 (Paddon); 267,854 (Stoeber); 228,799 (Desjardins) and 301,623 (Young) as well as U.S. Pat. No. 2,203,552 (Teevin).

In modern years, electrical heating, especially electrical baseboard heaters have become extremely popular. However, the disappearance of central hot air heating systems comprising a central humidifier has resulted in an increase in air dryness in homes during the heating season.

OBJECT OF THE INVENTION

It is an object of the invention to provide a humidifier which may be easily attached to a baseboard heater.

It is another object of this invention to provide such a humidifier which is very economical to manufacture.

It is still another object of this invention to provide such a humidifier which is easy to use and is not cumbersome.

Briefly, the invention involves a humidifier for a baseboard heater of the type comprising a body having an open front portion in which is placed a heating element and a panel placed in front of said heating element and wherein said panel defines with said body a lower opening and an upper opening, the humidifier comprising means to attach said humidifier in front of said front panel, a container portion, and air entrance means located above said container portion in alignment with said upper opening. The humidifier comprises:

means to attach said humidifier to the front of said baseboard heater;

a container portion;

air entrance means located above said container portion in alignment with said upper opening.

It is an object of this improvement to provide a humidifier having a high rate of transfer of humidity to the air.

It is another object to provide a humidifier wherein sponge, open cell foam or the like serves to increase the surface of the water which will be in contact with the hot air.

It is still another object to provide a humidifier having an insert placed in the container which comprises a lower section, an intermediate section and an upper section; said upper section, intermediate section and lower section being made of a substance having a capillary potential such that water can be elevated by capillary flow from said lower section to said upper section.

BRIEF DESCRIPTION OF THE DRAWINGS

The present invention will best be understood with reference to the following specification when taken in connection with the accompanying drawings wherein.

DETAILED DESCRIPTION OF THE PREFERRED EMBODIMENTS

Figure 1:
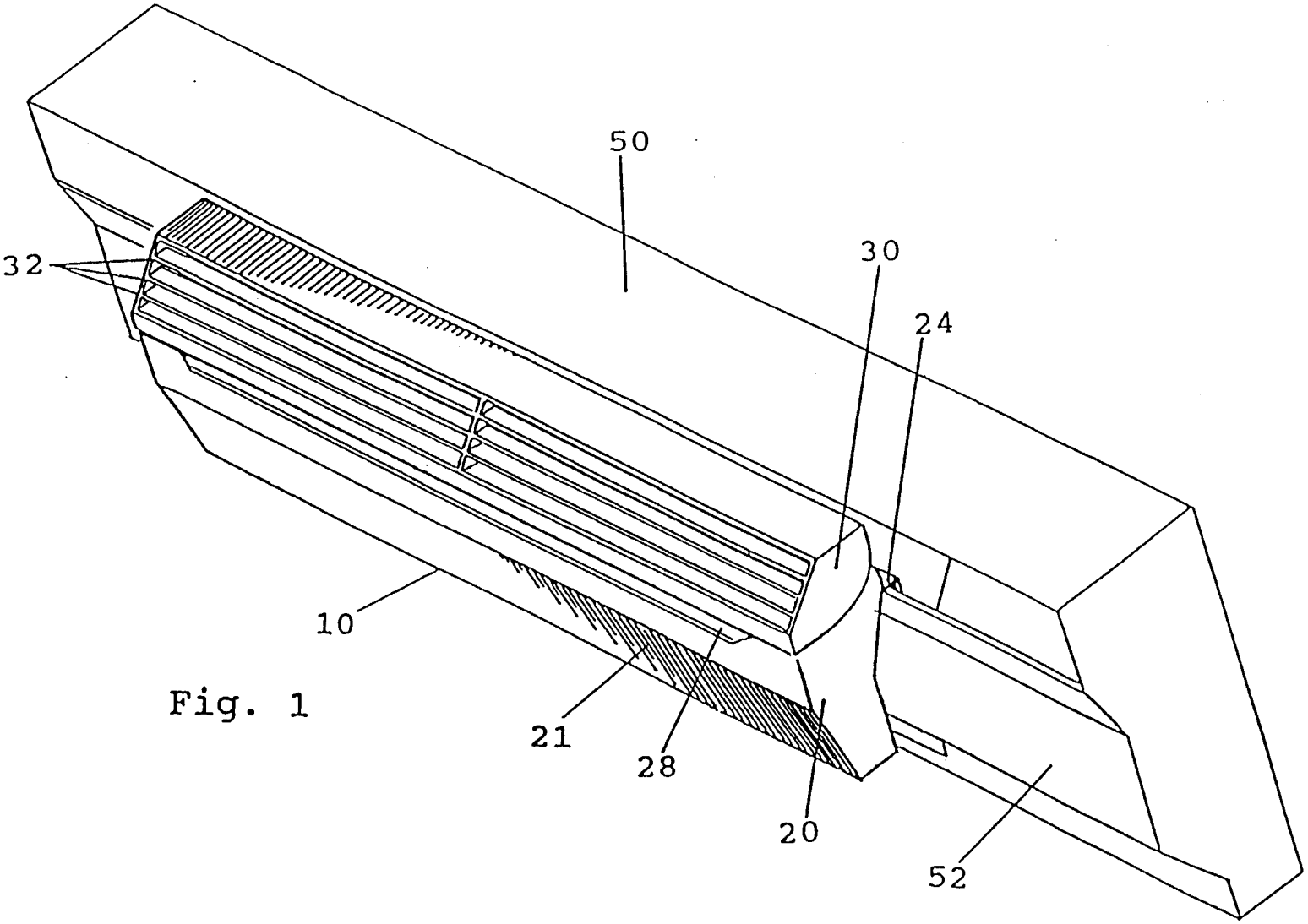
FIG. 1 perspective view of a first embodiment of a humidifier incorporating the present invention as mounted on an electrical baseboard.
Figure 3:
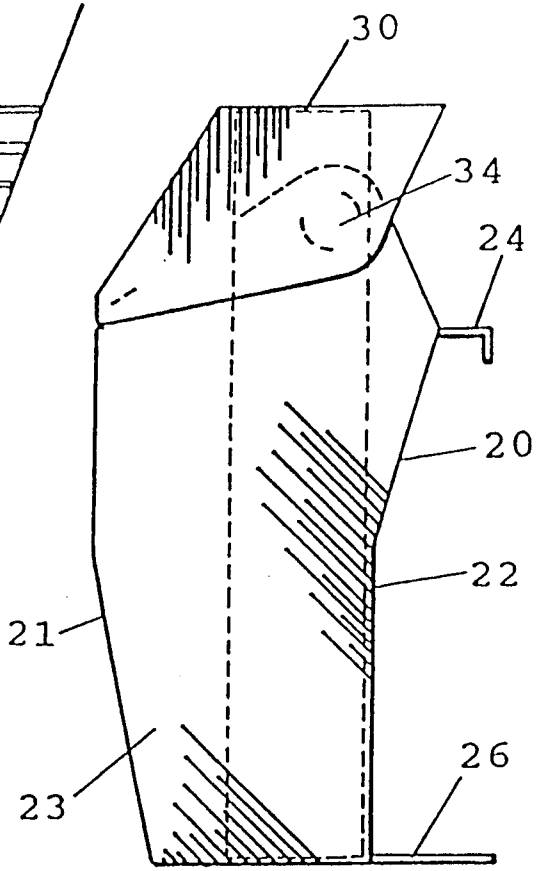
FIG. 3 is a side view of the humidifier shown in FIGS. 1 and 2.
Figure 2:
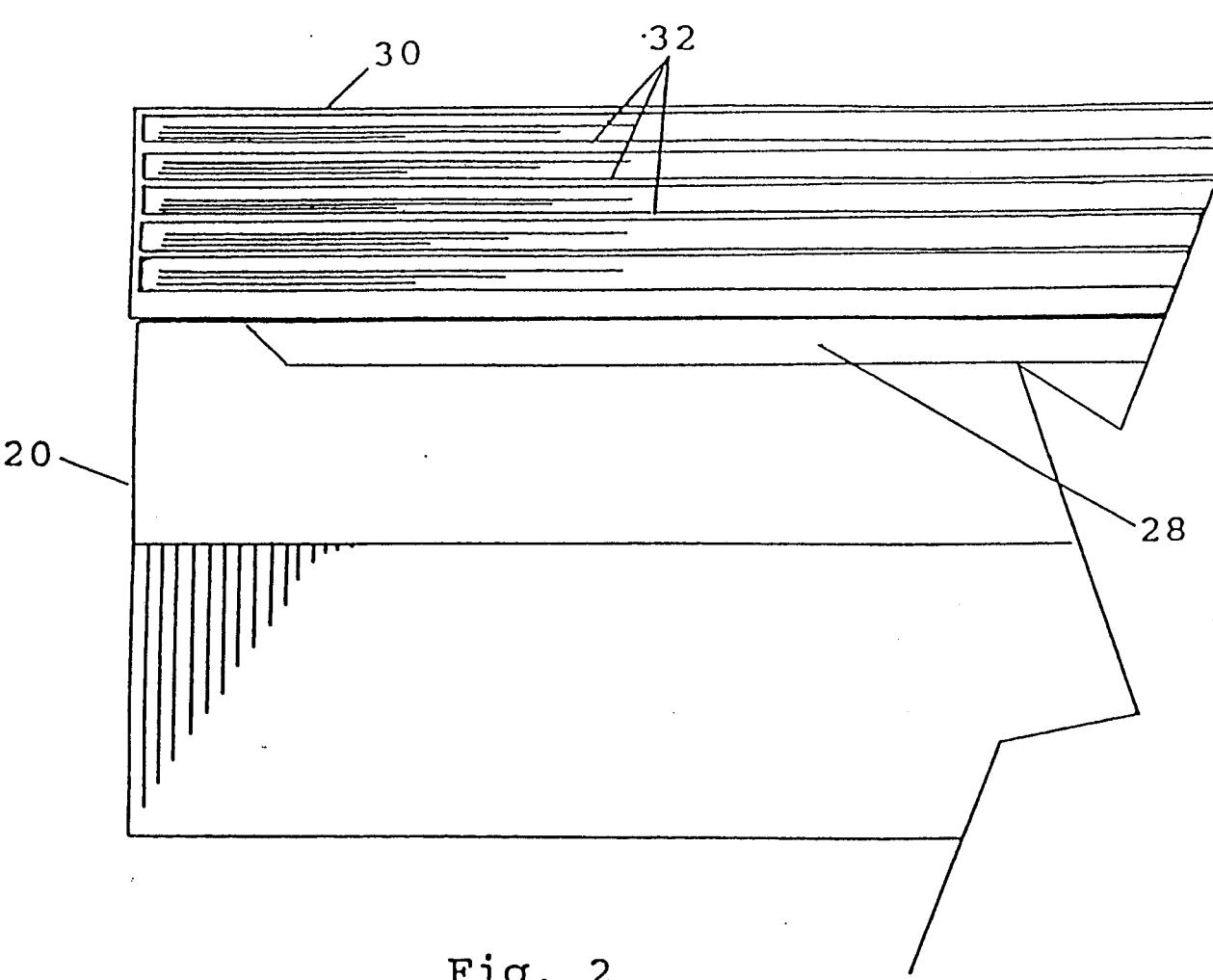
FIG. 2 is a partial front view of the humidifier shown in FIG. 1.

Turning now to the drawings and referring particularly to FIGS. 1, 2 and 3, a humidifier attachable to a baseboard heater and more particularly to an electrical baseboard heater 50 is indicated generally by the reference numeral 10 and includes a container portion 20 and a deflector portion 30.

The container portion 20 comprises a front wall 21, a rear wall 22 and a pair of lateral walls 23. Holding means 24 can be an L-shaped member or members which extend along the upper edge of rear wall 22. The configuration of rear wall 22 may be identical to the configuration of front panel 52 of baseboard 50 or an extension 26 or a plurality of extensions 26 may be disposed along the lower edge of said rear wall 22 to provide proper fit over the front cover 52 of said baseboard heater 50.

The deflector portion 30 comprises a plurality of fins 32 disposed substantially horizontally along the front portion of said deflector. The deflector is pivotally attached to the container portion 20 by means of a pair of pivots 34.

Figure 5:
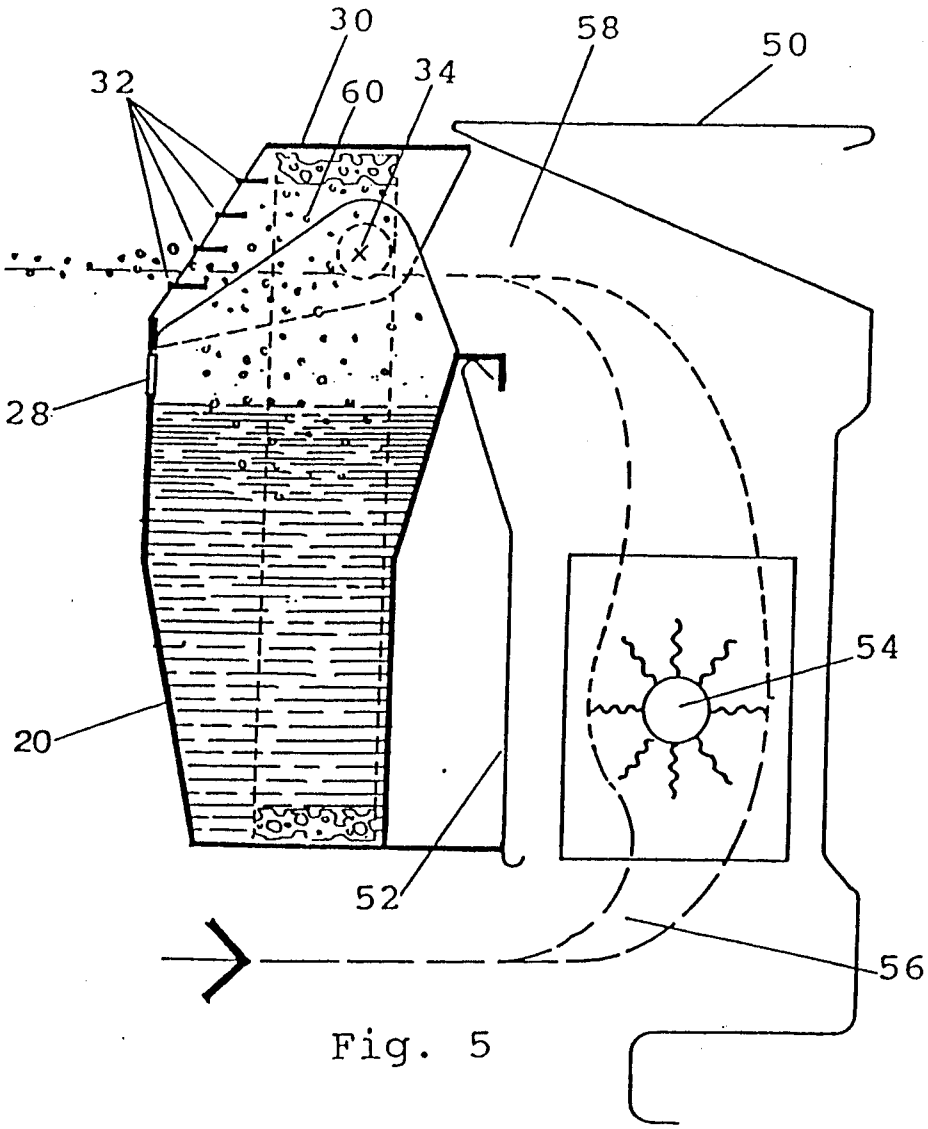
FIG. 5 a side sectional view of the humidifier and baseboard of FIG. 1.
Figure 4:
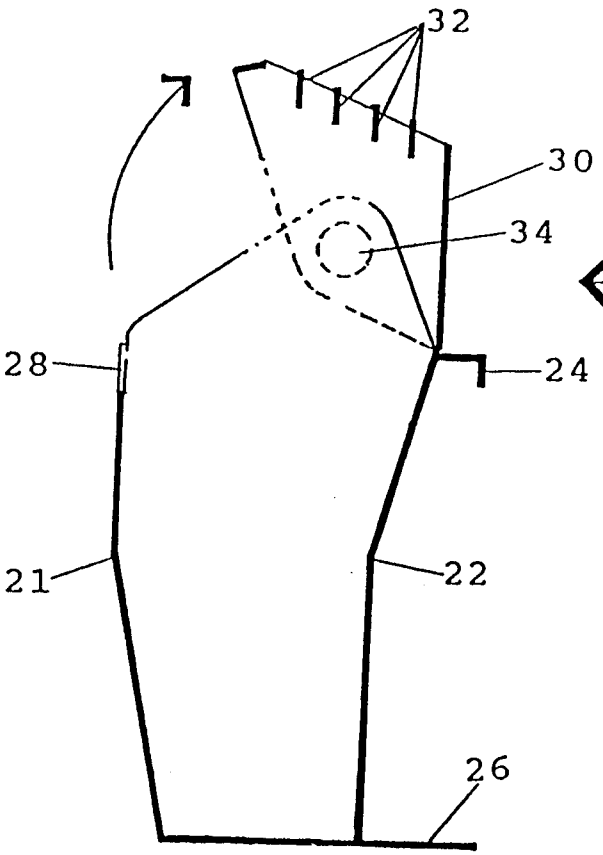
FIG. 4 side sectional view of the humidifier of FIG. 1 showing the deflector portion in its opened position.

To use the humidifier, it needs simply to be attached to the front panel 52 of the baseboard heater 50 by engaging the hook(s) 24 over the top edge of said front cover and pressing extension(s) 26 against the lower portion of said front panel 52 or, if a snugger fit is required, under the lower edge of said front panel 52 until it snaps in place. The deflector portion 30 is then moved to the position shown in FIG. 4 and water is introduced in the container portion until the level is near the overflow 28. With additional reference to FIG. 5, the drawings show that the uppermost or "roof"portion of deflector portion 30 substantially blocks the opening of the baseboard heater through which the heated air flows just before humidification. The deflector is then brought back to the position shown in FIG. 5.

As the heating element 54 of the baseboard 50 operates, the cool air is pulled by convection from underneath the container portion 20 at 56, then over the heating element 54 of the baseboard 50 and is expelled into the deflector portion 30 of the humidifier 10. There, the dry hot air picks up humidity (shown schematically as spheres 60) from the water contained in the container portion 20 before being expelled from the humidifier through the openings between deflectors 32.

Figure 7:
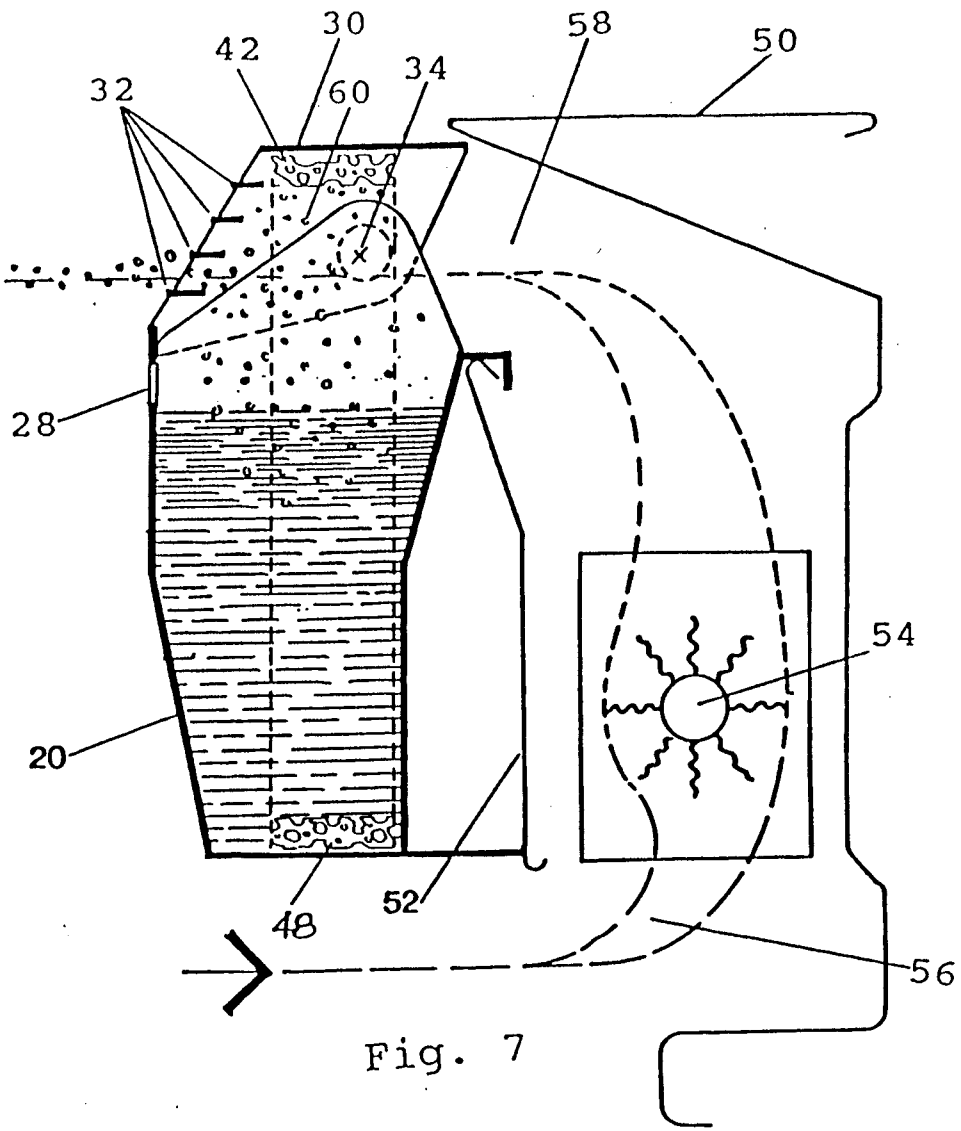
FIG. 7 is a side sectional view similar to FIG. 5 of the embodiment of the humidifier shown in FIG. 6.
Figure 6:
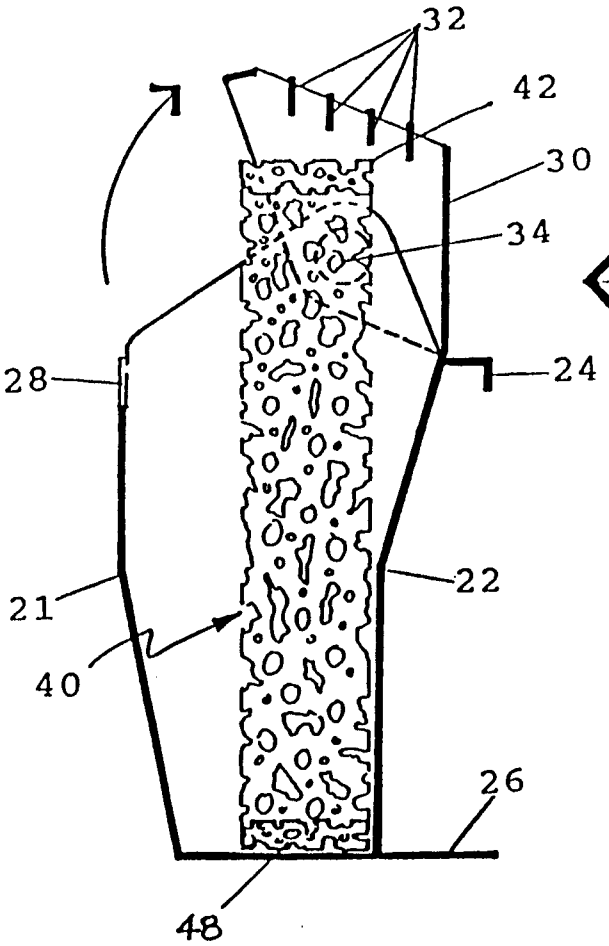
FIG. 6 is a side sectional view of another embodiment of the invention similar to FIG. 4 showing an insert that has been placed in the container portion.
Figure 8:
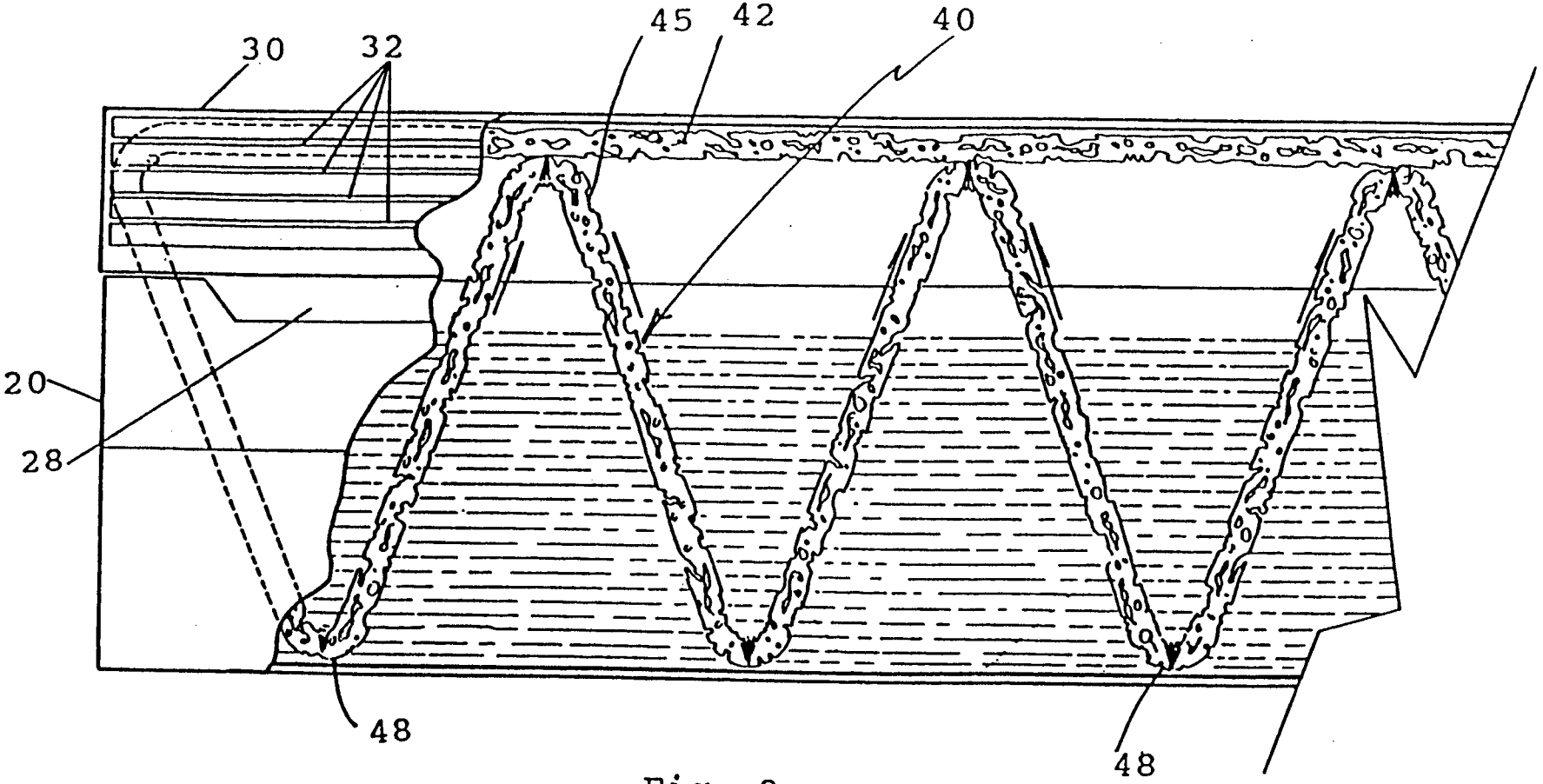
FIG. 8 is a partial front section view of the humidifier of the embodiment of FIG. 6.

A detailed description of another embodiment of the invention is set out in the drawings, more particularly in FIGS. 6, 7 and 8. FIGS. 6 and 7 correspond to FIGS. 4 and 5. An insert 40 is placed in container portion 20 of the humidifier. The insert 40 comprises an upper portion 42 connected to a lower portion 48 via an intermediary portion 45.

Figure 9:
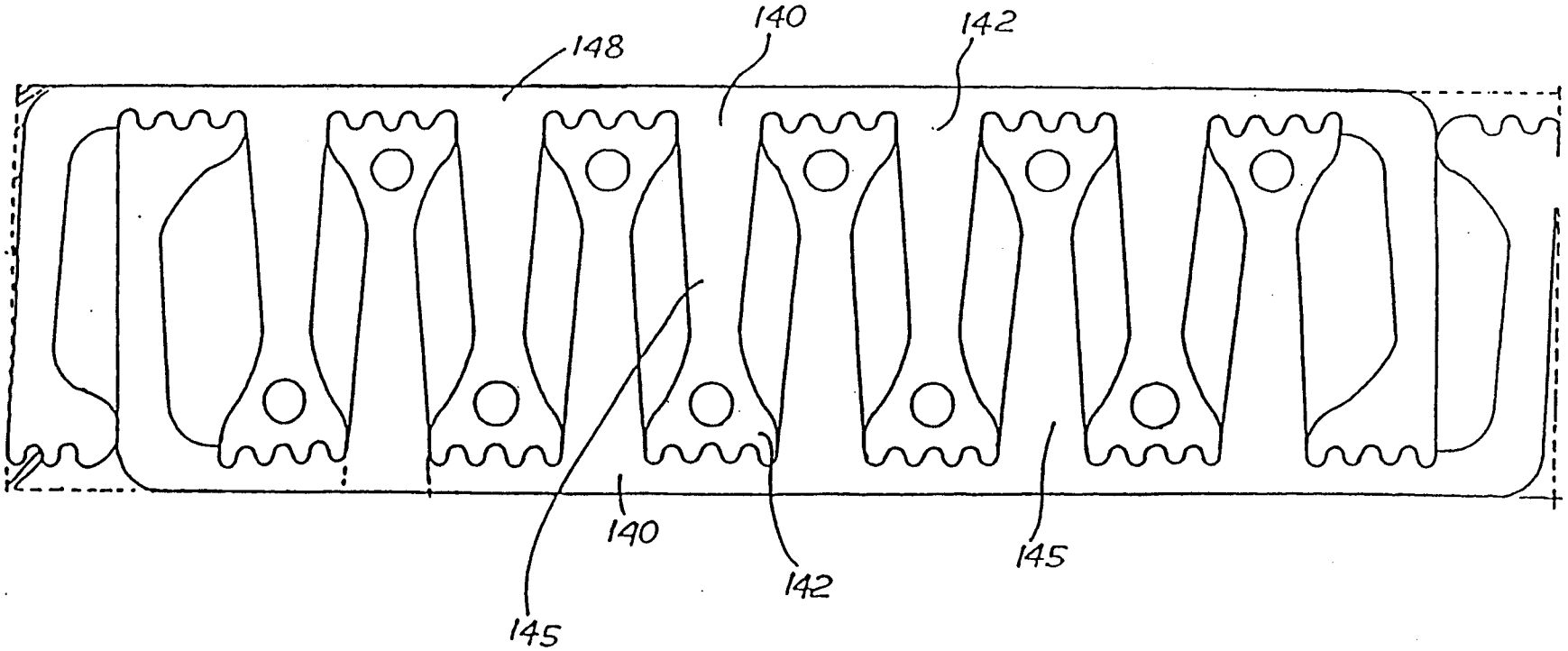
FIG. 9 is a front elevation view of a block of material used to make two (2) units of another embodiment of the present invention.

A modification of the insert that is part of the humidifier of FIGS. 6-8 is shown in FIG. 9, wherein insert 140 comprises an upper portion 142 connected to a lower portion 148 via member 145.

Inserts 40 and 140 operate in the same way. As previously described, when the heating element 44 of the baseboard 50 operates, the cool air is pulled by convection from underneath the container portion 20 at 56, then over the heating element 54 of the baseboard 50 and is expelled into the deflector portion 30 of the humidifier 10 at 58. There, the dry hot air picks up humidity (shown schematically as spheres 60) from the water contained in the container portion 20 before being expelled from the humidifier through the openings between deflectors 32.

This system works but is more efficient when the level of water in container 20 is high. Indeed, as the water in container 20 evaporates, the waterline moves towards the bottom of container 20 thus, getting further and further removed from the hot air which is traveling from the upper opening 58 in baseboard 50 towards deflectors 32 of the deflector portion 30. When an insert made of sponge, open cell foam or another substance having a capillary potential such that water can be elevated by capillarity from said lower section 48 to said upper section 42 is utilized, the rate of transfer of the humidity to the air is much greater, especially when the level of the water in container 20 is low.

Although a particular and preferred embodiment of the present invention is described, it is contemplated that various changes in materials and arrangement of the various parts may be made by those skilled in the art within the spirit and scope of the present invention.

Accordingly, it is intended that the scope of the invention be not determined solely by reference to the embodiments described but rather be determined by reference to the claims hereinafter provided and their equivalents.

I claim:

1. A humidifier for attachment to a baseboard heater of the type having an air intake opening and an air outlet opening and defining an airflow passage therebetween in which air is warmed by a heating element before exiting the air outlet opening, the humidifier comprising:

container means for storing water, said container means including an upper opening through which the container means is filled with water and water stored in the container means evaporates;

cover means pivotably attached to said container means at an upper portion thereof, said cover means including means through which air exiting from the baseboard heater passes and is humidified when said cover means is in a first position, wherein said container means is arranged to be filled with water when said cover means is in a second position, and wherein said cover means further includes a roof portion which defines the top of the air humidification passageway when the cover means is in said first position, and which substantially blocks the air humidification passageway when said cover means is in said second position.

2. A humidifier for attachment to a baseboard heater as claimed in claim 1, further comprising an insert placed in said container means, said insert comprising a lower section, an upper section and an intermediate section, said insert having a capillary potential such that water stored in said container means can be elevated by capillarity from said lower section to said upper section.

3. A humidifier for attachment to a baseboard heater as claimed in claim 1, wherein said means for attaching the container means to a baseboard heater includes hook means located at the cover means upper portion, said hook means being arranged for attachment at the air outlet opening of the baseboard heater.

4. A humidifier for attachment to a baseboard heater as claimed in claim 2, further comprising an insert placed in said container means, said insert comprising a lower section, an upper section an intermediate section, said insert having a capillary potential such that water stored in said container means can be elevated by capillarity from said lower section to said lower section.

5. A humidifier for attachment to a baseboard heater as claimed in claim 1, wherein said means for attaching the container means to a baseboard heater includes attachment means arranged at the respective upper and lower portions of the container means for press-fitting the container means to the baseboard heater.

6. A humidifier for attachment to a baseboard heater as claimed in claim 5, further comprising an insert placed in said container means, said insert comprising a lower section, an upper section and an intermediate section, said insert having a capillary potential such that water stored in said container means can be elevated by capillarity from said lower section to said upper section.

7. A humidifier for attachment to a baseboard heater as claimed in claim 1, wherein said container means comprises overflow means for preventing water from overflowing into the baseboard heater.

8. A humidifier for attachment to a baseboard heater as claimed in claim 7, further comprising an insert placed in said container means, said insert comprising a lower section, an upper section and an intermediate section, said insert having a capillary potential such that water stored in said container means can be elevated by capillarity from said lower section to said upper section.

* * * * *